US007639186B2

(12) United States Patent
Chang

(10) Patent No.: US 7,639,186 B2
(45) Date of Patent: Dec. 29, 2009

(54) DUAL BAND ANTENNA

(75) Inventor: The-Nan Chang, Taipei (TW)

(73) Assignees: Tatung Company, Taipei (TW); Tatung University, Taipei (TW)

( * ) Notice: Subject to any disclaimer, the term of this patent is extended or adjusted under 35 U.S.C. 154(b) by 44 days.

(21) Appl. No.: 11/962,123

(22) Filed: Dec. 21, 2007

(65) Prior Publication Data

US 2009/0096677 A1 Apr. 16, 2009

(30) Foreign Application Priority Data

Oct. 11, 2007 (TW) ..... 96137989 A

(51) Int. Cl.
*H01Q 1/38* (2006.01)

(52) U.S. Cl. ..... 343/700 MS

(58) Field of Classification Search ..... 343/700 MS, 343/702, 846, 833–834
See application file for complete search history.

(56) References Cited

U.S. PATENT DOCUMENTS

| | | | | |
|---|---|---|---|---|
| 1,551,079 | A | 8/1925 | Walder et al. | |
| 4,072,951 | A | 2/1978 | Kaloi | |
| 5,828,340 | A * | 10/1998 | Johnson | 343/700 MS |
| 6,937,193 | B2 * | 8/2005 | Hendler et al. | 343/700 MS |
| 7,042,401 | B2 * | 5/2006 | Park et al. | 343/700 MS |
| 7,239,283 | B2 * | 7/2007 | Chua | 343/746 |
| 7,324,049 | B2 * | 1/2008 | Myoung et al. | 343/700 MS |
| 7,324,059 | B2 * | 1/2008 | Lee et al. | 343/795 |
| 2003/0020656 | A1 * | 1/2003 | Shor | 343/700 MS |
| 2003/0210187 | A1 | 11/2003 | Wong et al. | |
| 2003/0222823 | A1 * | 12/2003 | Flint et al. | 343/702 |
| 2004/0017315 | A1 | 1/2004 | Fang et al. | |
| 2004/0160368 | A1 * | 8/2004 | Huang | 343/700 MS |
| 2005/0116873 | A1 | 6/2005 | Castany et al. | |

OTHER PUBLICATIONS

Article titled "Wideband CPW-fed monopole antenna with parasitic elements and slots" authored by Chung et al., Electronics Letters Aug. 19, 2004 vol. 40 No. 17 pp. 1038-1040.

Article title "Analysis of the Small Band-Rejected Antenna with the Parasitic Strip for UWB" authored by Kim et al., IEEE Transactions on Antennas and Propagation, vol. 54, No. 6, Jun. 2006 pp. 1688-1692.

* cited by examiner

*Primary Examiner*—Huedung Mancuso
(74) *Attorney, Agent, or Firm*—Jianq Chyun IP Office

(57) ABSTRACT

A dual band antenna covering both DTV and ISM bands is provided in the present invention. The antenna includes a signal line, a coupling block, a ground part and at least a floating metal strip, wherein the signal line and the coupling block are etched on upside of a substrate and connected with each other with an inset feeding structure, and the ground part and the floating metal strip are etched on backside of the substrate.

9 Claims, 7 Drawing Sheets

DUAL BAND ANTENNA

CROSS-REFERENCE TO RELATED APPLICATION

This application claims the priority benefit of Taiwan application serial no. 96137989, filed on Oct. 11, 2007. The entirety of the above-mentioned patent application is hereby incorporated by reference herein and made a part of this specification.

BACKGROUND OF THE INVENTION

1. Field of the Invention

The present invention relates to a dual band antenna. More particularly, the present invention relates to a dual band antenna covering both digital TV (DTV) and industrial, scientific and medical (ISM) bands.

2. Description of Related Art

After years of research and development, a DTV now may be a hand-held device, and a computer or a notebook computer may also receive DTV signals via a suitable receiving interface. As to a communication product, design of an antenna is essential, since the quality of the antenna design affects the quality of communication. For example, the antennas include external antennas and embedded antennas, the external antenna includes monopole antenna, dipole antenna and helix antenna etc., and the embedded antenna includes planar inverted F antenna (PIFA) and microstrip antenna.

Due to diversified requirement in wireless transmission and wireless communication, an electronic device is generally required to support different wireless transmission interfaces and different transmission bands. When signals of different bands, such as the ISM band of 2.4 GHz~2.3835 GHz and the aforementioned DTV band (for example 469 MHz~882 MHz, which may be different in different countries) are required to be integrated within the electronic device, a general solution is to set different antennas for receiving the signals with different bands. However, since the hand-held electronic device requires features of light-weighted and slim, setting of a plurality of antenna groups not only increases a cost of the electronic device, but also increases a size of the electronic device, which is of no avail to the design of the electronic device.

SUMMARY OF THE INVENTION

The present invention is directed to a dual band antenna, by applying a microstrip line structure and a floating metal strip etched on lower surface thereof, the dual band antenna may cover both DTV and ISM bands.

The present invention provides a dual band antenna including a signal line, a coupling block, a ground part and at least a floating metal strip, wherein the signal line and the coupling block are etched on upside of a substrate and are connected with each other with an inset feeding structure, and the floating metal strip is etched on backside of the substrate, and disposed at a position corresponding to setting positions of the inset feeding structure and the ground part.

In an embodiment of the present invention, there is a layout spacing between the floating metal strip and the ground part.

In an embodiment of the present invention, the coupling block has an Λ-shaped symmetrical structure, and a connecting part of the signal line and the coupling block is located at a central part of the coupling block.

In an embodiment of the present invention, the inset feeding structure has a first groove and a second groove respectively located on two sides of the signal line.

In an embodiment of the present invention, a shape of the coupling block is an inverted triangle, a V shape or a rectangle, and the shape of the floating metal strip is a rectangle.

In an embodiment of the present invention, a coupling gap is formed between a forward projection of the coupling block on the backside of the substrate and the ground part, and the coupling gap corresponds to a layout pattern of the coupling block.

In an embodiment of the present invention, the substrate is a circuit printed board made of fibreglass (FR4).

In an embodiment of the present invention, the dual band antenna has two operation bands including a DTV band and an ISM band.

In the present invention, by applying the microstrip line and the corresponding floating metal strip etched on backside thereof, the antenna could be operating in dual band, and resonant frequency and bandwidth of the antenna around the ISM band may be adjusted by adjusting dimensions of the layout structure of the floating metal strip. Since the dual band antenna of the present invention may cover both the DTV band and the ISM band, it has a great commercial value, and the dual band antenna may be directly applied to hand-held electronic devices or general multi-band communication devices.

In order to make the aforementioned and other objects, features and advantages of the present invention comprehensible, a preferred embodiment accompanied with figures is described in detail below.

DESCRIPTION OF EMBODIMENTS

The First Embodiment

Figure 1:
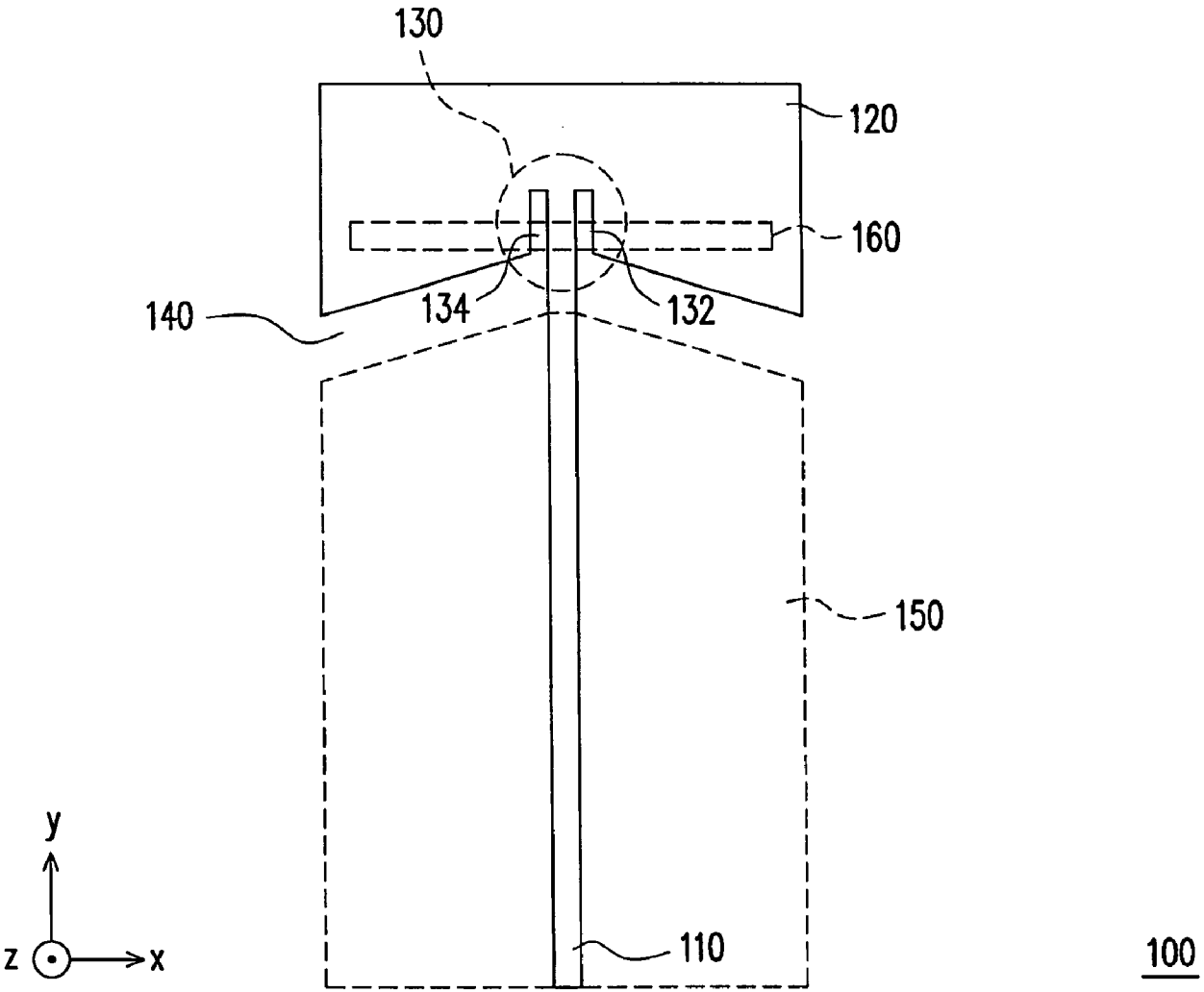
FIG. 1 is a schematic diagram illustrating a structure of a dual band antenna according to the first embodiment of the present invention.

FIG. 1 is a schematic diagram illustrating a structure of a dual band antenna according to the first embodiment of the present invention. Referring to FIG. 1, the dual band antenna 100 includes a signal line 110, a coupling block 120, a ground part 150 and a floating metal strip 160, wherein a connecting part of the coupling block 120 and the signal line 110 has an inset feeding structure 130. The signal line 110 and the coupling block 120 (shown as solid lines) are etched on upside of a substrate (now shown), and the ground part 150 and the floating metal strip 160 (shown as dash lines) are etched on backside of the substrate.

The substrate of the present embodiment may be a double-sided printed circuit board (PCB) made of FR4, and the structure of the dual band antenna 100 is formed on both upside and backside of the double-sided PCB. The dual band antenna 100 of the present embodiment has two operational bands including a DTV band and an ISM band. Therefore, a communication device equipped with the dual band antenna 100 of the present embodiment may simultaneously transceiving wireless signals of two bands without applying a plurality of antennas.

The coupling block 120 is an Λ-shaped symmetrical structure, and the connecting part of the signal line 110 and the coupling block 120 is located at a central part of the coupling block 120. The inset feeding structure 130 has a first groove 132 and a second groove 134 respectively located on two sides of the signal line 110, such that the connecting part of the signal line 110 and the coupling block 120 may form a concave feeding structure. The floating metal strip 160 is etched on backside of the substrate and located corresponding to a setting position of the inset feeding structure 130, and has no connection with the ground part 150. A coupling gap 140 is formed between a forward projection of the coupling block 120 on the backside of the substrate and the ground part 150, and the coupling gap 140 corresponds to a layout pattern of the coupling block 120. As shown in FIG. 1, an Λ-shaped structure is formed on the bottom of the coupling block 120, and therefore an Λ-shaped structure is also formed on the top of the ground part 150 for matching the coupling block 120.

Figure 2B:
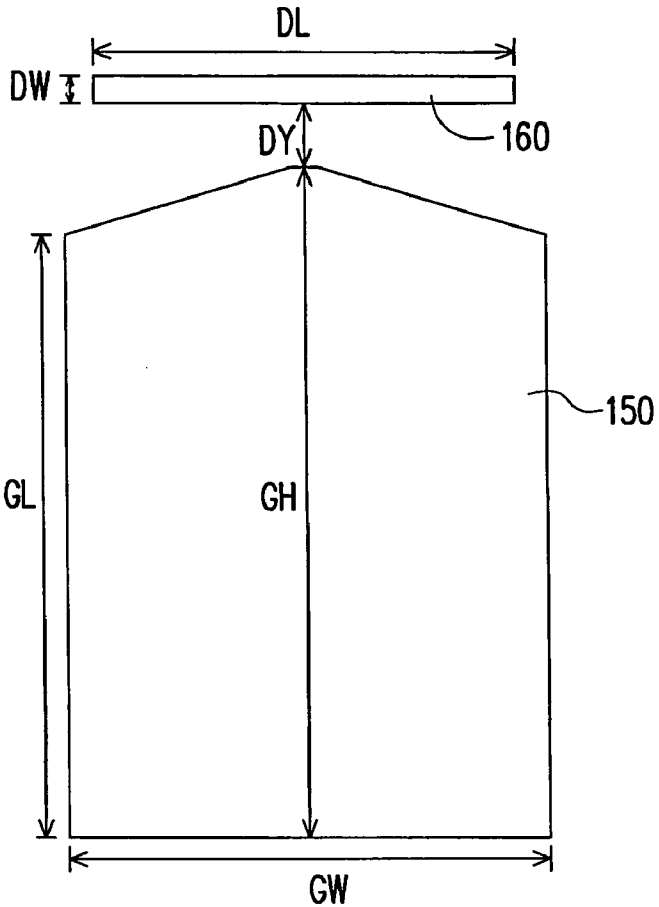
FIG. 2B is a structural diagram illustrating a ground area of a dual band antenna according to the first embodiment of the present invention.
Figure 2A:
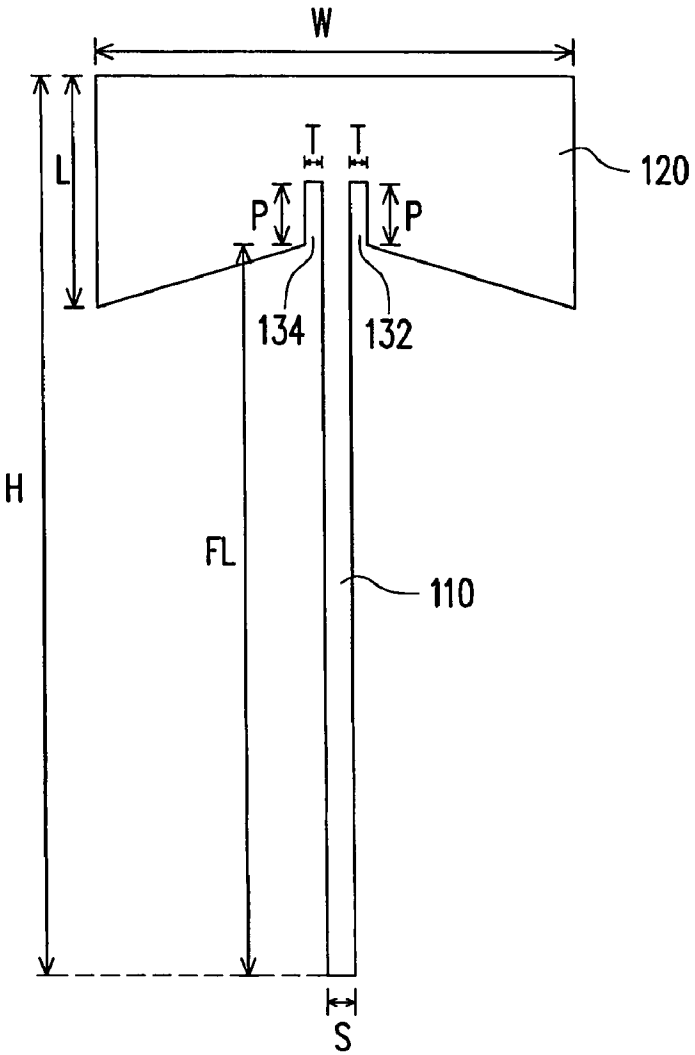
FIG. 2A is a structural diagram illustrating a signal area of a dual band antenna according to the first embodiment of the present invention.

In the present embodiment, a structure including the signal line 110 and the coupling block 120 on the upside of substrate is regarded as a signal area, and the structure including the ground part 150 and the floating metal strip 160 on the backside of the substrate is regarded as a ground area. Referring to FIGS. 2A and 2B, FIG. 2A is a structural diagram illustrating a signal area of a dual band antenna according to the first embodiment of the present invention. FIG. 2B is a structural diagram illustrating a ground area of a dual band antenna according to the first embodiment of the present invention. The parameters W, L, FL, H, P, T, S of FIG. 2A are layout dimensions for the signal line 110 and the coupling block 120, and the parameters GL, GH, GW, DL, DW, DY of FIG. 2B are layout dimensions for the ground part 150 and the floating metal strip 160, wherein the parameter DY represents a layout spacing between the floating metal strip 160 and the ground part 150. In the present embodiment, the parameters DW, DL, DY may be variables, and may be used for adjusting a frequency response of the dual band antenna within the ISM band. Referring to table 1 for the values of other dimensions, table 1 is a layout parameter table according to the first embodiment of the present invention.

TABLE 1

| | Parameter | | | | | | | | | |
|---|---|---|---|---|---|---|---|---|---|---|
| | W | L | GL | GH | GW | FL | H | P | T | S |
| Length (mm) | 74 | 42 | 161.5 | 175 | 74 | 185 | 216 | 15 | 2 | 2.5 |

TABLE 1-continued

| | Parameter | | | | | | | | | |
|---|---|---|---|---|---|---|---|---|---|---|
| | W | L | GL | GH | GW | FL | H | P | T | S |

Figure 3A:
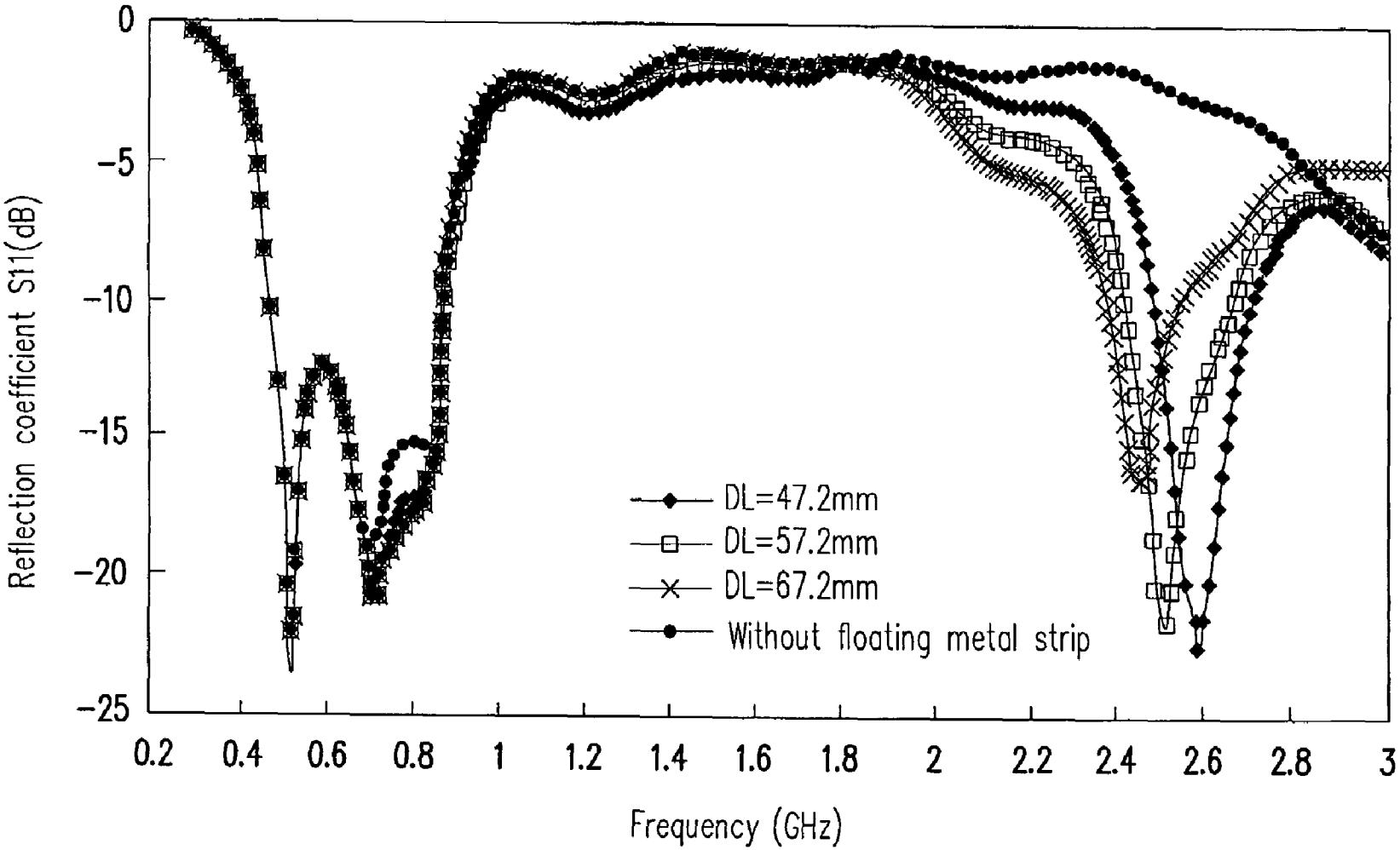
FIG. 3A is a frequency response simulation diagram based on parameters DL of a dual band antenna and reflection coefficients thereof according to the first embodiment of the present invention.
Figure 3B:
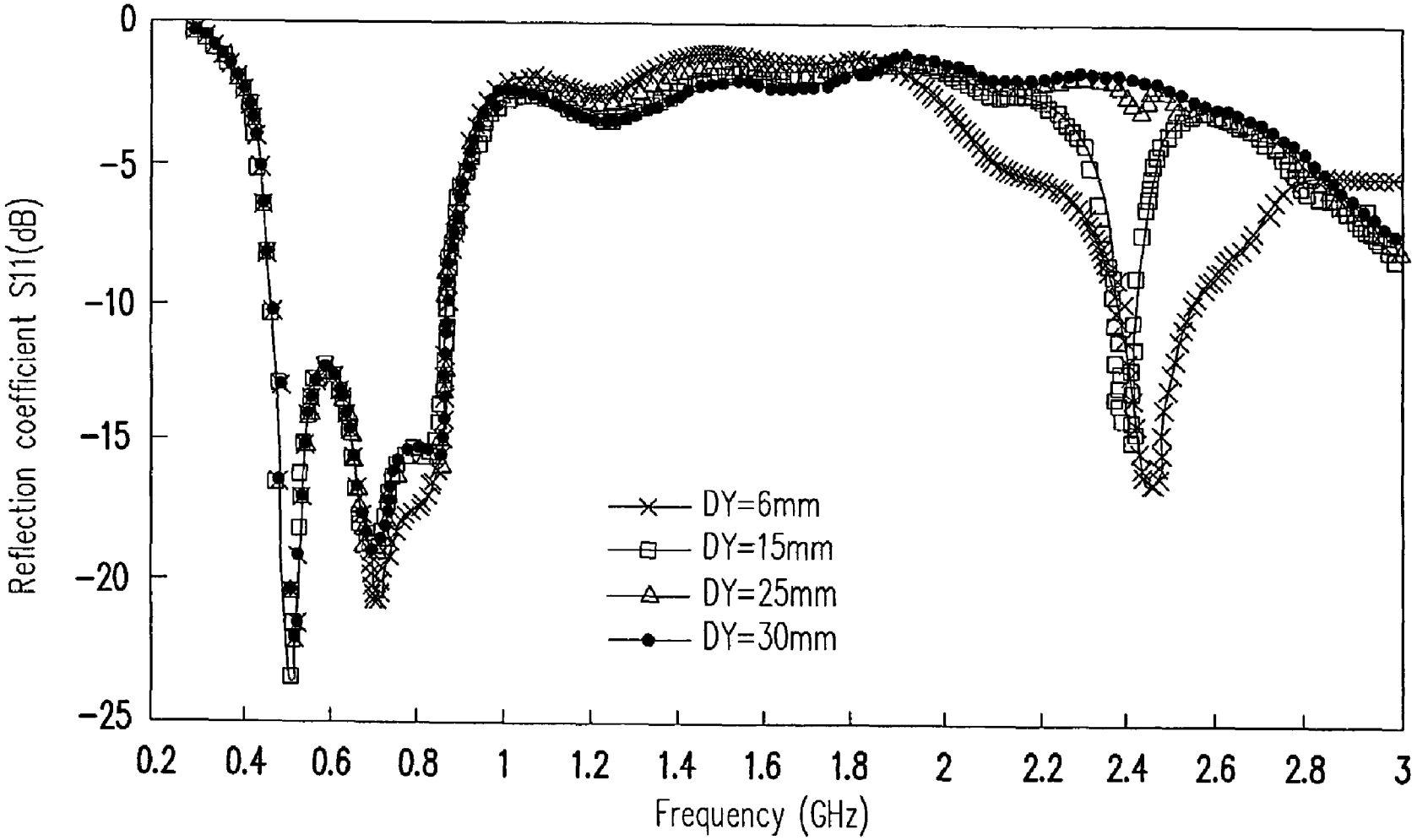
FIG. 3B is a frequency response simulation diagram based on parameters DY of a dual band antenna and reflection coefficients thereof according to the first embodiment of the present invention.

Wherein, the parameters P and T determine sizes of the first groove 132 and the second groove 134, and resonant frequency and bandwidth of the dual band antenna 100 around 469 MHz~882 MHz of the DTV band may be adjusted by adjusting the parameters P and T. The parameters DL, DW and DY are used for representing a layout structure of the floating metal strip 160, and in the present embodiment, the resonant frequency and the bandwidth of the dual band antenna 100 within the ISM band may be adjusted by adjusting the parameters DW, DL, and DY. For example, in the present embodiment, the parameter DW is assumed to be 3 mm, the parameters DL and DY then may be adjusted to simulate frequency response diagrams shown as FIGS. 3A and 3B. FIG. 3A is a frequency response simulation diagram based on parameters DL of a dual band antenna and reflection coefficients thereof according to the first embodiment of the present invention. FIG. 3B is a frequency response simulation diagram based on parameters DY of a dual band antenna and reflection coefficients thereof according to the first embodiment of the present invention. Moreover, it should be noted that besides the parameters DW, DL and DY, other structure dimensions of the dual band antenna may be referred to table 1, however, the present invention is not limited to the parameter values shown in table 1.

Referring to FIG. 3A, a y-axis represents the reflection coefficients S11, and an x-axis represents the frequencies (GHz), and the frequency response simulation diagram corresponding to the reflection coefficients S11 under four simulation conditions of the parameter DL respectively being 47.2 mm, 57.2 mm, and 67.2 mm, and without the floating metal strip 160 are shown in FIG. 3A. According to FIG. 3A, adjusting of the parameter DL mainly influence the resonant frequencies within the ISM band. The greater the parameter DL is, the more likely the resonant frequency trends towards low frequencies, meanwhile, the greater the reflection coefficient S11 is, and the lesser a corresponding return loss (i.e. a reciprocal of an absolute value of the reflection coefficient) is. In the present embodiment, if the parameter DL is 47.2 mm, the resonant frequency thereof is about 2.6 GHz, and the corresponding reflection coefficient S11 is the minimum value, which is about −23 dB. If no floating metal strip 160 is applied to the dual band antenna 100, the resonant frequencies within the ISM band then disappear, and therefore applying of the floating metal strip 160 is one of the main technical approaches for the dual band antenna 100 generating the resonant frequencies of the ISM band. Moreover, according to FIG. 3A, adjusting of the parameter DL has no obvious influence to the resonant frequencies of the DTV band with relatively low frequencies, and therefore frequency response features of the dual band antenna 100 within the DTV band is not influenced.

Referring to FIG. 3B, a y-axis represents the reflection coefficients S11, and an x-axis represents the frequencies (GHz), and the frequency response simulation diagram corresponding to the reflection coefficients S11 under four simulation conditions of the parameter DY respectively being 6 mm, 15 mm, 25 mm and 30 mm are shown in FIG. 3B. According to FIG. 3B, the greater the spacing between the floating metal strip 160 and the ground part 150 is (the greater the parameter DY is), the smaller the bandwidth of the dual band antenna 100 within the ISM band is. When the parameter DY is 25 mm or 30 mm, operational bandwidth of the dual band antenna 100 within the ISM band almost disappears. When the parameter DY is 6 mm, operational bandwidth within the ISM band is increased. Therefore, bandwidth of the dual band antenna 100 within the ISM band may be adjusted by adjusting the spacing between the floating metal strip 160 and the ground part 150. Similarly, variation of setting positions of the floating metal strip 160 has little influence to the resonant frequencies or frequency response features of the dual band antenna 100 within the DTV band.

According to FIGS. 3A and 3B, for different design requirement, the resonant frequency and bandwidth of the dual band antenna 100 within the ISM band may be adjusted by adjusting the layout dimensions and the setting position of the floating metal strip 160. However, the setting position of the floating metal strip 160 should corresponds to that of the inset feeding structure 130 and the ground part 150, and when the floating metal strip 160 is excessively far away from the ground part 150 (meanwhile, far away from the inset feeding structure 130), the whole frequency response features of the dual band antenna 100 within the ISM band is changed accordingly.

During an actual measurement, the parameters of the present embodiment are set as: parameter DL=67.2 mm, parameter DW=3 mm, parameter DY=6.72 mm, and material of the substrate is FR4, and a thickness thereof is 1.6 mm, a permittivity is 4.4 $\epsilon$ r, and other structural parameters of the antenna may be referred to table 1. Within a band for a wireless local area network (WLAN), a measured 10 dB bandwidth of the dual band antenna is 2.36 GHz~2.55 GHz. Within the low frequencies, a simulated 10 dB return loss bandwidth is 467.3 MHz~866.2 MHz, which are cover the DTV bands of all countries.

In the present embodiment, polarized directions of the dual band antenna 100 within the two bands (the DTV band and the ISM band) are all y direction (referring to FIG. 1 for the y direction), and in case of the above two operational bands, a radiation field of the antenna 100 is similar to that of a half wave length dipole antenna, namely, the antenna 100 has a radiation field that all bands have an omni-directional pattern in a xz plane, and have a figure of eight pattern in a yz plane.

Figure 4:
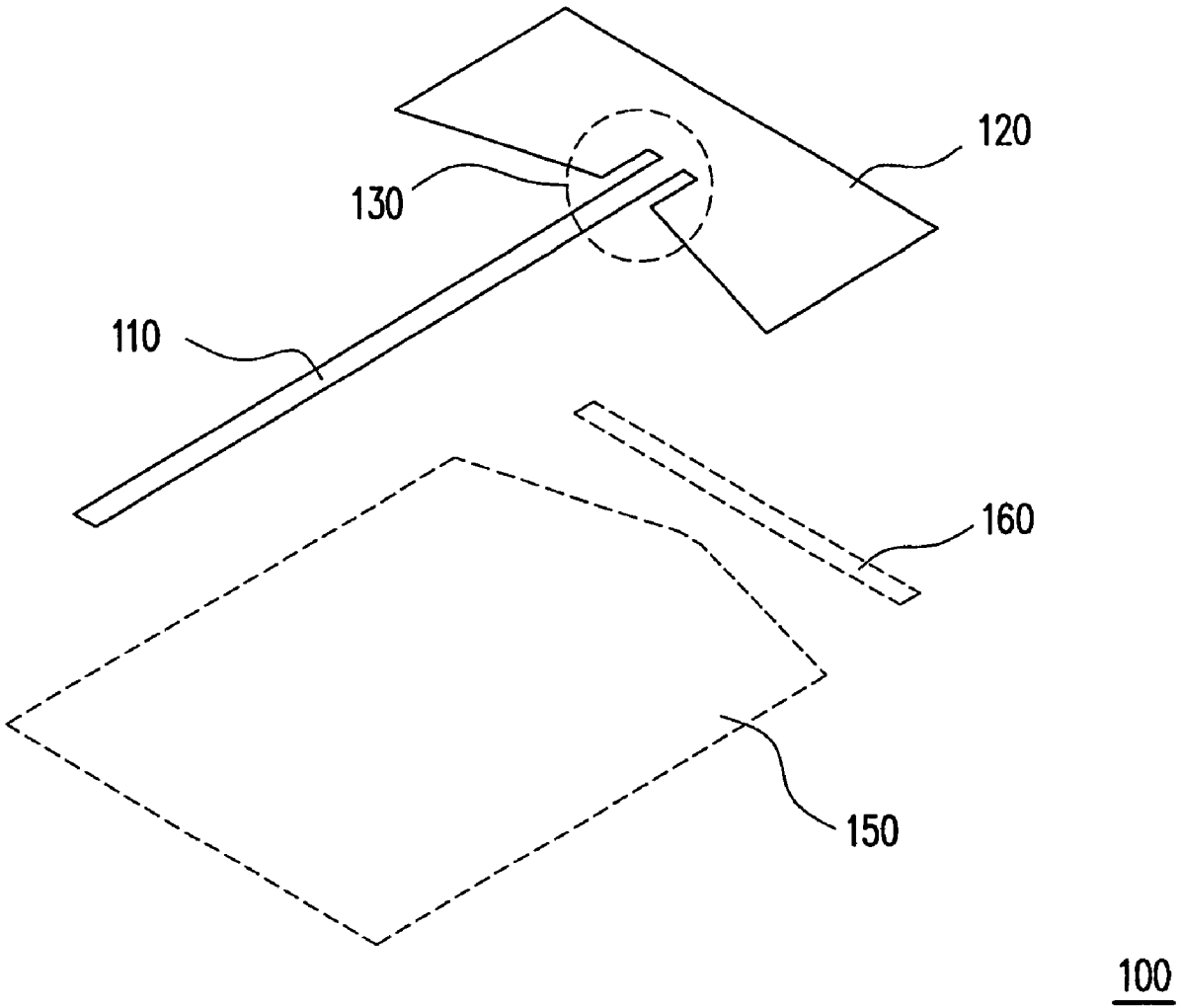
FIG. 4 is a perspective view of a dual band antenna according to the first embodiment of the present invention.

FIG. 4 is a perspective view of a dual band antenna according to the first embodiment of the present invention. The signal line 110 and the coupling block 120 shown in solid lines are etched on the upside of the substrate, and the ground part 150 and the floating metal strip 160 shown in dash lines are etched on the backside of the substrate. The upside and backside of the substrate represent the two sides of the double-sided printed circuit board. However, structural direction of the dual band antenna is not limited thereof, the two sides may also be exchanged. Those skilled in the art may easily deduce other implementation details according to FIG. 4 and the aforementioned description of the present embodiment, and therefore the detailed description thereof will not be repeated.

The Second Embodiment

Figure 5:
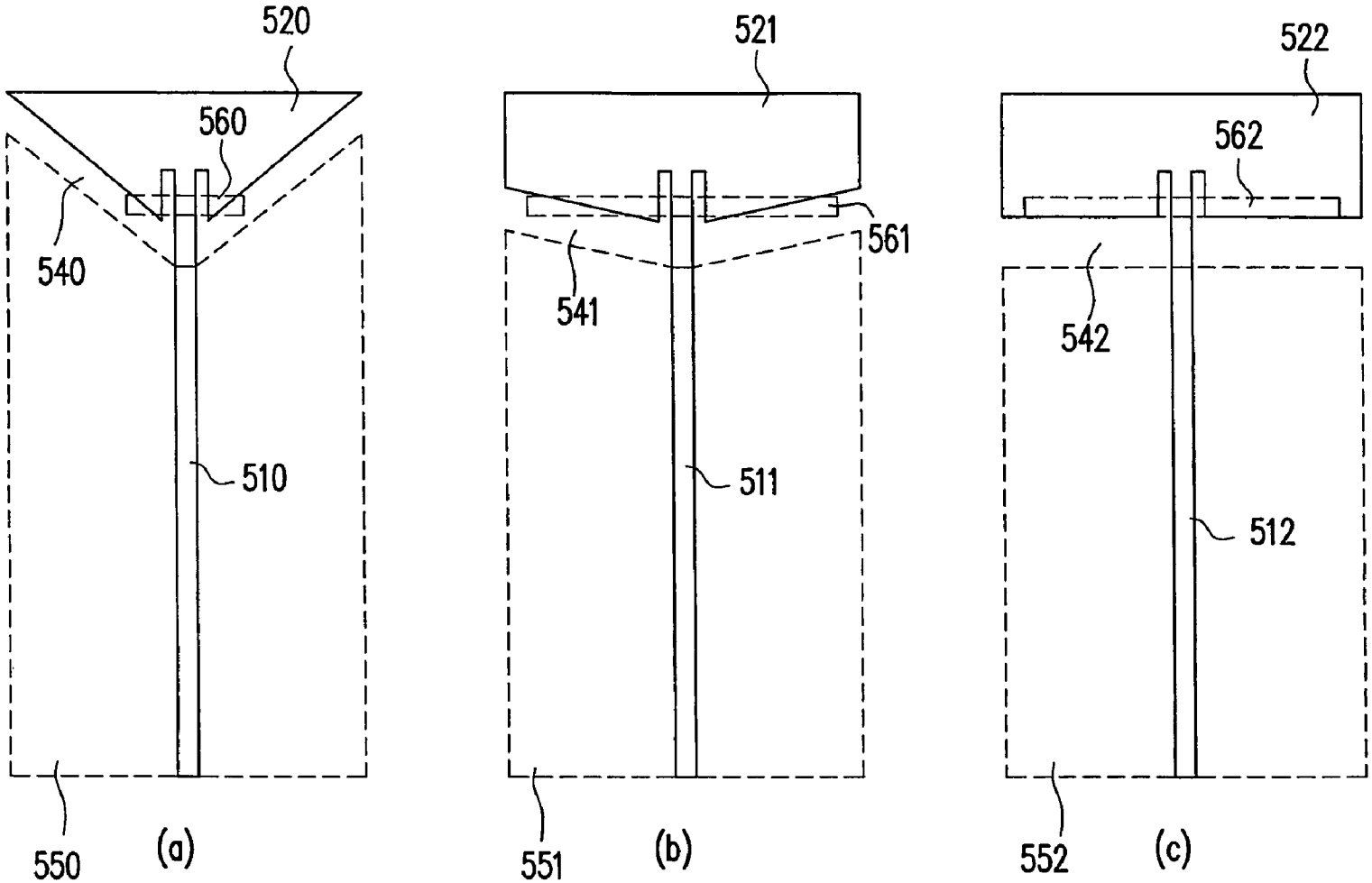
FIG. 5 is a schematic diagram illustrating a plurality of structures of a dual band antenna according to the second embodiment of the present invention.

In the present invention, shapes of the coupling block and the ground part are not limited to the Λ-shaped symmetrical structure as that in the first embodiment. Referring to FIG. 5, FIG. 5 is a schematic diagram illustrating a plurality of structures of a dual band antenna according to the second embodiment of the present invention. FIGS. 5(*a*), 5(*b*) and 5(*c*) are schematic diagrams respectively illustrating three structures of the coupling blocks 520, 521 and 522, which respectively are an inverted triangle, a V shape and a rectangle. The shapes of the ground parts 550, 551 and 552 are respectively corresponds to that of the coupling blocks 520, 521 and 522, and coupling gaps 540, 541 and 542 are respectively formed there between. It should be noted that designs of the floating metal strips 560, 561 and 562 should be matched with the shapes of the ground parts 550, 551 and 552, so as to avoid short circuits with the ground parts 550, 551 and 552.

Structurally, FIGS. 5(*a*), 5(*b*) and 5(*c*) are the same to that of the first embodiment, by which the dash lines represent the floating metal strips 560, 561 and 562 and the ground parts 550, 551 and 552 etched on the backside of the substrate; and the solid lines represent the signal lines 510, 511 and 512 and the coupling blocks 520, 521 and 522 etched on the upside of the substrate. Other detailed structural designs may be referred to the first embodiment for a reference, and may be easily deduced by those skilled in the art, and therefore the detailed description thereof will not be repeated.

The Third Embodiment

Figure 6:
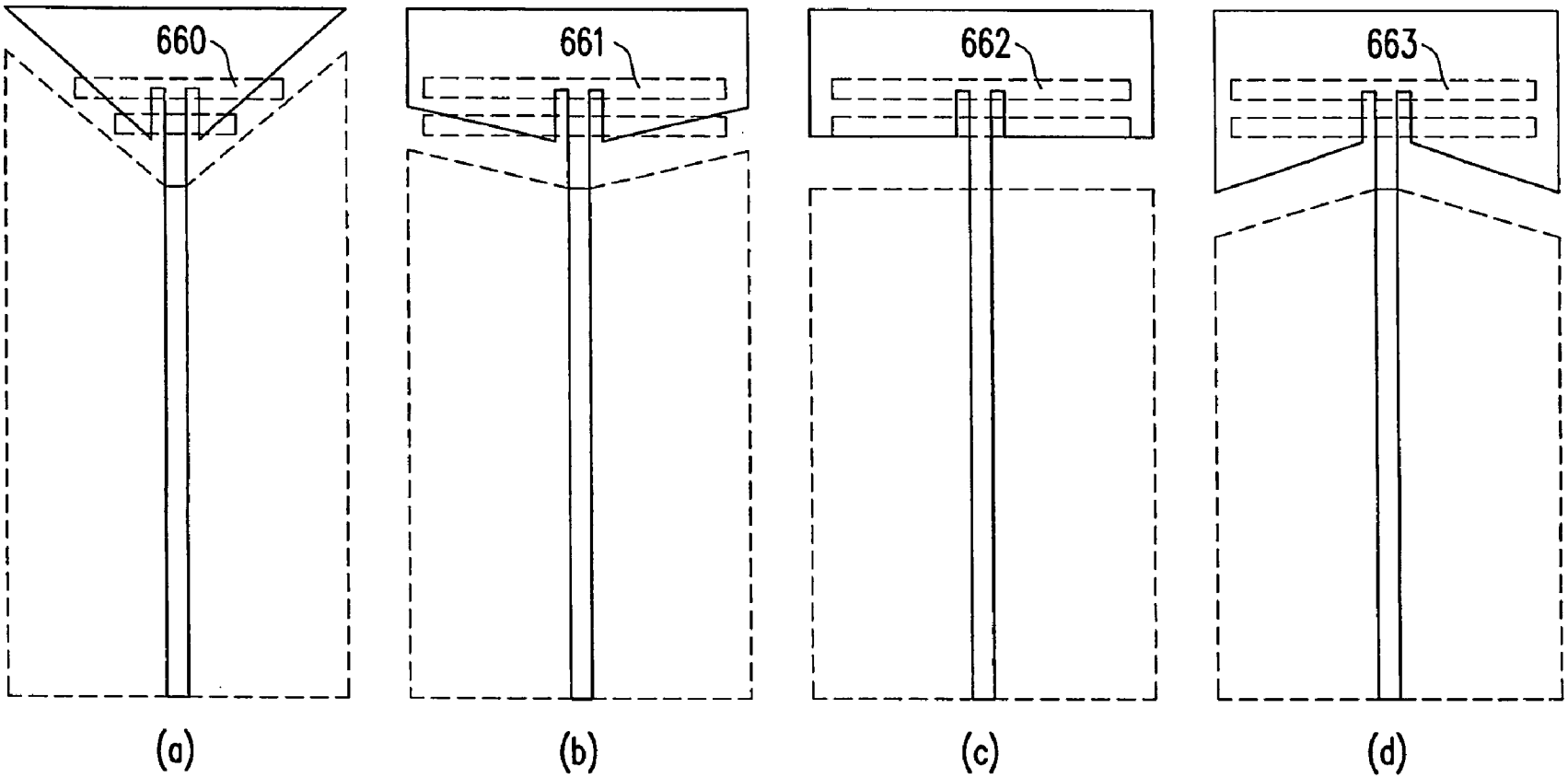
FIG. 6 is a schematic diagram illustrating a plurality of structures of a dual band antenna according to the third embodiment of the present invention.

In this embodiment, a plurality of the floating metal strips may be applied according an actual design requirement. Referring to FIG. 6, FIG. 6 is a schematic diagram illustrating a plurality of structures of a dual band antenna according to the third embodiment of the present invention. The difference of FIGS. 6(*a*), 6(*b*), 6(*c*) and 6(*d*) and the aforementioned FIGS. 5(*a*), 5(*b*), 5(*c*) and FIG. 1 is that second floating metal strips 660, 661, 662 and 663 are applied. The resonant frequencies and bandwidths of the dual band antenna within the ISM band may also be adjusted by adjusting the setting positions and the layout dimensions of the floating metal strips 660, 661, 662 and 663. Other detailed structural designs may be referred to the first embodiment and the second embodiment for a reference, and therefore the detailed description thereof will not be repeated.

In summary, the structure of the dual band antenna according to the present invention is suitable for a coplanar antenna with dual band of the DTV band and the ISM band. Within the DTV band, the bandwidth may be increased according to an inset feeding structure. When the floating metal strip is applied, current density along the inset area of the antenna is quite different with that of an antenna without the floating metal strip, and in case of the floating metal strip being applied, the guided current may be actuated to generate a second operation frequency with a relatively high frequency. According to an experiment result, the polarized direction of the second operation frequency is the y direction, not an x direction, and therefore a main function of the floating metal strip of the present invention is to actuate a high-order harmonic of the antenna which originally just having DTV operation frequencies, which is different from a method that a parasitic structure (for example, the floating metal strip of the present invention) is actuated by a coupling approach and the radiation is generated by the parasitic structure itself. Therefore, according to the experiment result, the antenna of the present invention may not only radiate within the DTV band, but may also effectively radiate within the ISM band. On the other hand, a main application band for a radio frequency identification (RFID) tag is 430 MHz and 2.45 GHz, and the dual band antenna of the present invention could be also applied to a RFID antenna. Signals transceiving of the multi-band may be effectively achieved by the dual band antenna of the present invention, by which a unique antenna is applied for substituting the antennas respectively used for the two bands, such that the antennas could be integrated, and design complexity and fabrication cost is reduced accordingly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A dual band antenna, comprising:

a signal line, etched on upside of a substrate;

a coupling block, etched on upside of the substrate and coupled to one end of the signal line, wherein a connecting part of the signal line and the coupling block has an inset feeding structure;

a ground part, etched on backside of the substrate and disposed corresponding to a setting position of the signal line; and at least one floating metal strip, etched on backside of the substrate, and disposed corresponding to setting positions of the inset feeding structure and the ground part.

2. The dual band antenna as claimed in claim 1, wherein the floating metal strip is spaced from the ground part with a layout spacing.

3. The dual band antenna as claimed in claim 1, wherein the coupling block has a Λ-shaped symmetrical structure, and the connecting part of the signal line and the coupling block is located at a central part of the coupling block.

4. The dual band antenna as claimed in claim 1, wherein the inset feeding structure has a first groove and a second groove respectively etched on two sides of the signal line.

5. The dual band antenna as claimed in claim 1, wherein a shape of the coupling block comprises an inverted triangle, a V shape or a rectangle.

6. The dual band antenna as claimed in claim 1, wherein a coupling gap is formed between a forward projection of the coupling block on the backside of the substrate and the ground part, and the coupling gap corresponds to a layout pattern of the coupling block.

7. The dual band antenna as claimed in claim 1, wherein the shape of the floating metal strip comprises a rectangle.

8. The dual band antenna as claimed in claim 1, wherein the substrate is a printed circuit board made of fiberglass.

9. The dual band antenna as claimed in claim 1, wherein the dual band antenna has a first operational band and a second operational band, the first operational band is a digital TV band, and the second operational band is an industrial, scientific and medical band.

* * * * *